US006195523B1

(12) United States Patent
Sakai

(10) Patent No.: US 6,195,523 B1
(45) Date of Patent: Feb. 27, 2001

(54) IMAGE FORMING APPARATUS, METHOD THEREFOR AND RECORDING MEDIUM

(75) Inventor: Shinichi Sakai, Kashiwazaki (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/317,274

(22) Filed: May 24, 1999

(30) Foreign Application Priority Data

May 27, 1998 (JP) ..... 10-161535

(51) Int. Cl.[7] ..... G03G 15/16
(52) U.S. Cl. ..... 399/296; 399/307
(58) Field of Search ..... 399/296, 391, 399/237, 307; 430/126

(56) References Cited

U.S. PATENT DOCUMENTS 5,558,970 * 9/1996 Landa et al. ..... 430/126
5,572,274 * 11/1996 Lior et al. ..... 399/296

* cited by examiner

*Primary Examiner*—William J. Royer
(74) *Attorney, Agent, or Firm*—Ostrolenk, Faber, Gerb & Soffen, LLP

(57) ABSTRACT

An image forming apparatus is provided in which the anti-blocking property of the ink is largely improved, while maintaining high bonding strength of the ink to the printing paper. The latent image formed on the photosensitive belt 1 by a laser or the like is developed by a developing roller 3 using an ink 2 composed of toner particles dispersed in a specified solvent. After development, a designated amount of the solvent of the ink 2 is removed by a squeezing roller 4, and the surface of the photosensitive belt 1 is coated with a cross-linking material a for cross-linking the molecular structure of the ink 2 by a vessel 10 storing the cross-linking material a and a roller 8 which are disposed in contact with the photosensitive belt 1 between the squeezing roller 4 and a transfer roller 5. The ink used for development on the photosensitive belt is cross-linked and dried to be fixed on the printing paper 7 inserted between the transfer roller 5 and the fuser roller 6, both of which have an internal heater.

6 Claims, 1 Drawing Sheet

IMAGE FORMING APPARATUS, METHOD THEREFOR AND RECORDING MEDIUM

BACKGROUND OF THE INVENTION

1. Field of the Invention

This invention relates to a image forming apparatus, a method therefor, and a recording medium for realizing the image forming, and more particularly, relates to a image forming apparatus, a method therefor, and a recording medium for realizing the image formation, which uses the particular characteristics of the ink that the solidified ink is transferred to a material having a higher affinity with the dried ink when the ink comprised of toner particles dispersed in a solvent is used, and that the ink is solidified by removing the solvent in the ink.

This invention is based on Patent Application No. Hei 10-161535 filed in Japan, the content of which is incorporated herein by reference.

2. Background Art

Conventional electronic image forming apparatuses obtain copies by the steps of forming latent electric images on a photosensitive material, developing latent images by using toner, and fixing by heating or pressing after transferring the toner images to transfer materials such as paper.

Such an image forming apparatus based on the electrophotographic technique uses the principle that the solidified ink is transferred to a material having higher affinity to the ink when an ink comprised of toner particles dispersed in a solvent is used, and the ink is solidified by removing the solvent. This ink is characterized in that it can be solidified by removing the solvent in an environment having temperatures of more than 10° C.

However, inks used for the conventional image forming apparatuses have the drawbacks that the bonding strength of the toner image to the paper is low, and that blocking, which is the phenomenon of the image surfaces sticking to each other, is likely to occur.

A cross-linking of the molecular structure of the ink may be effective for improving the bonding strength of the toner image with the printing paper. However, cross-linking of the ink generally increases the solidification temperature of the ink, which causes problems in that it becomes difficult to solidify the ink when the solvent of the ink is squeezed by a roller and the developed images are deformed or even flown off the paper.

The objects of the present invention are to solve the above problems. That is, one object is to increase the bonding strength of the developed images to the printing paper, and another object is to improve the anti-blocking property of the image surfaces.

SUMMARY OF THE INVENTION

According to the first aspect of the present invention, an image forming device includes: a photosensitive belt made of a photosensitive body for forming latent images; a developing roller for developing the latent images by the ink composed of toner particles dispersed in a specified solvent; a transfer roller which is in contact with the photosensitive belt and which has a internal heater; a fuser roller which is in contact with the transfer roller and which has a internal heater; and a transporting roller for transporting the printing paper between the transfer roller and the fuser roller and for transferring the ink to the printing paper.

The image forming machine further includes: a coating means for coating a cross-linking material for cross-linking the molecular structure of the ink forming the picture image by developing the image formed on the photosensitive belt. The coating means is in contact with the photosensitive belt between the developing roller and the transfer roller.

According to the second aspect of the present invention, the image forming apparatus according to the first aspect further includes a removing means for removing a designated amount of the solvent of the ink by pressurizing the ink. The removing means is located at a specified position between the coating means and the developing roller.

According to the third aspect of the present invention, the ink for forming images by developing the images formed on said photosensitive belt has the characteristics that it is solidified by removing the solvent of the ink by heat or pressure, and that it is transferable to a material which has a higher affinity to the ink.

According to the fourth aspect of the present invention, the affinities of the photosensitive belt, the transfer roller, and the printing paper increases according to the above order, and the printing paper has the highest affinity to the ink.

Coating a cross-linking material for cross-linking the molecular structure of the ink which forms the developed images on the photosensitive belt at a specified position between the developing roller and the transfer roller.

According to the sixth aspect of the present invention, the present invention provides a recording medium which stores a program for executing the method of forming images according to the fifth aspect.

DETAILED DESCRIPTION OF THE PREFERRED EMBODIMENT

Figure 1:
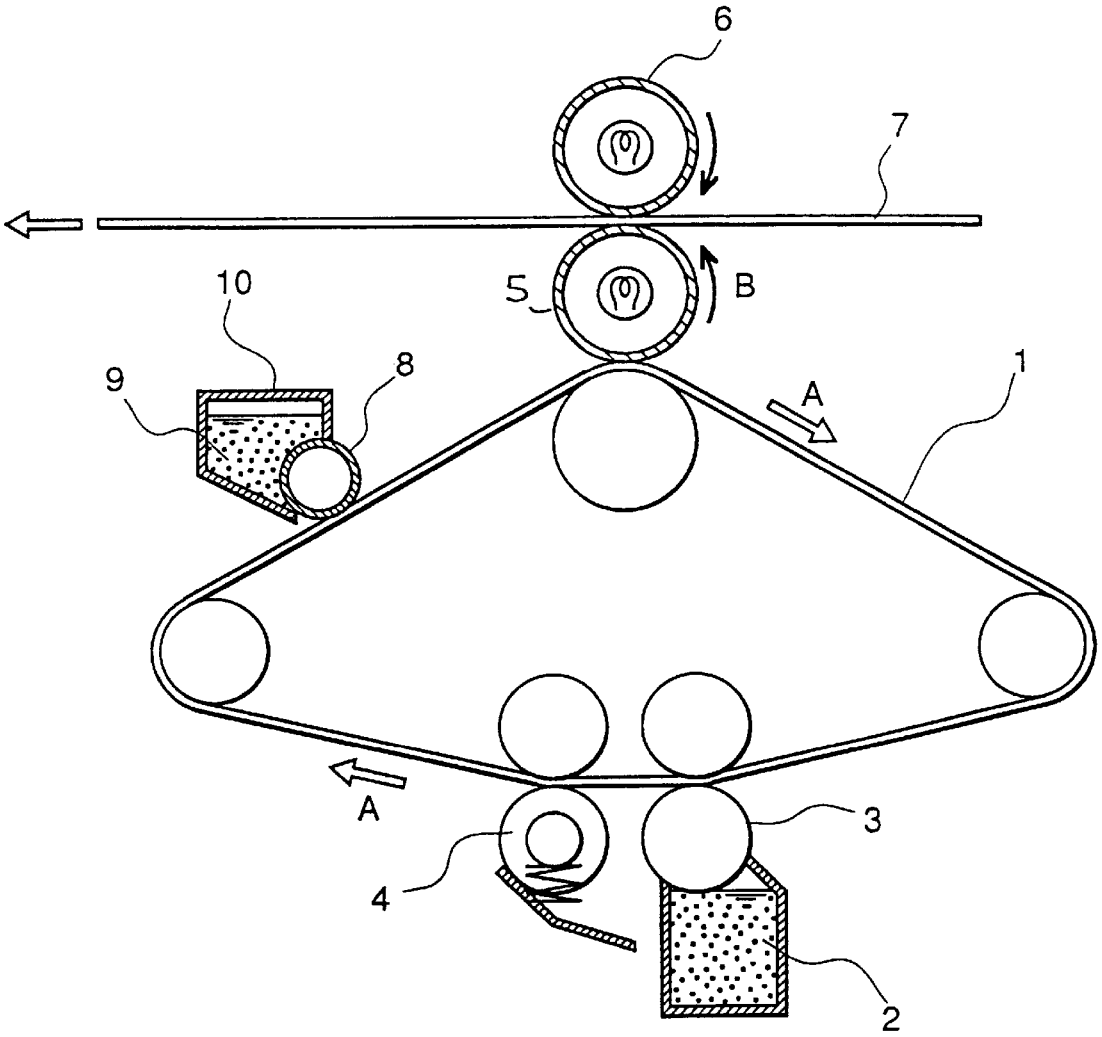
FIG. 1 is a diagram showing an example of the structure of the image forming device of the present invention.

FIG. 1 is a diagram showing an example of the structure of the image forming device of the present invention. As shown in FIG. 1, the image forming device of the present invention comprises a photosensitive belt 1 which is a photosensitive body for forming latent images, a developing roller 3 for developing the latent images on the photosensitive belt 1 by a toner, a squeezing roller 4 which is in contact with said photosensitive belt 1 and is used for squeezing the solvent of the ink by pressurizing the ink which forms images after development, a transfer roller 5 which is in contact with said photosensitive belt 1 and has an internal heater, and a fuser roller 6 which is in contact with the transfer roller 5 and has an internal heater. Printing papers 7 are transferred by transfer rollers (not shown) to the nip portion between the above transfer roller 5 and the fuser roller 6.

The ink 2 for forming images after development of the images on the photosensitive belt 1 has the characteristics that it solidities by removing the solvent by heat or pressure, and that it is transferred to a body which has a high affinity to the ink. The affinity to the dried ink increases in the order of the photosensitive belt 1, the transfer roller 5, and the printing paper 7, such that the ink 2 is transferred to the printing paper 7.

At a designated position in contact with the photosensitive roller 1 before the transfer roller 5 (between the transfer roller 5 and the squeezing roller 4), there is provided a vessel 10 for storing a cross-linking material 9 for cross-linking the molecular structure of the ink 2, and a roller 8 for coating the cross-linking material 9 on the photosensitive belt 1.

Hereinafter, the operation of the image forming apparatus will be described. The photosensitive belt 1 made of a photosensitive material is rotated in the direction of the arrow A in FIG. 1. After the photosensitive surface is homogeneously charged by an electrifier (not shown), a latent image is formed on the photosensitive surface by light irradiation from a laser or the like. Subsequently, similar to the electrophotographic technique, the latent image is developed by means of a developing roller 3 in which the ink 2, composed of toner particles dispersed in the solvent, adheres to the latent image formed on the photosensitive belt 1.

The ink 2 which forms the picture image developed on the photosensitive belt 1 has the characteristics that the ink is solidified by removing the solvent of the ink 2 by heat or pressure, and that the solidified ink is transferred to a material which has a high affinity with the ink 2. Thus, the ink 2 is pressed by the squeezing roller 4 abutting the photosensitive belt 1 for solidifying the ink to a certain extent by removing the solvent of the ink to some degree, and the ink 2 is further solidified by removing the solvent of the ink by the transfer roller 5, which has an internal heater.

By setting the affinity of the transfer roller 5 to the ink 2 higher than that of the photosensitive belt 1 to the ink 2, the ink 2 is transferred to the transfer roller 5. The transfer roller 5 rotates in the direction of the arrow B in the figure, and the printing paper 7 is sent to the nip portion between the fuser roller 6 and the transfer roller 5.

By setting the affinity of the transfer roller 5 to the ink 2 smaller than the affinity of the printing paper 7, the solidified ink 2 is transferred to the printing paper 7. The solvent of the ink is completely removed by heat and pressure applied to the ink, and the toner is fixed to the printing paper 7.

Since the transfer roller 5 is in contact with the photosensitive belt 1, there is a limit to the surface temperatures of the photosensitive belt and the transfer roller 5. Thus, the fixing strength of the toner to the printing paper 7 by the present image forming apparatus is likely to be slightly lower than that by the conventional image forming apparatus.

According to one embodiment of the present invention, as shown in FIG. 1, the image forming apparatus of the present invention is provided with a vessel 10 for storing a cross-linking material 9 and a roller 8 at a specific location between the transfer roller 5, and the squeezing roller 4 such that it is possible to coat the cross-linking material 9 on the photosensitive belt 1.

That is, the roller 8 is immersed in the cross-linking material a stored in the vessel 10, and the cross-linking material a is coated on the photosensitive belt 1 by making the roller 8 come in contact with the photosensitive belt 1. Accordingly, it becomes possible for the cross-linking material 9 to react with the ink 2 forming the developed picture image.

Therefore, the bonding strength of the picture image formed on the printing paper 7 after applying the heat and pressure at the nip portion between the transfer roller 5 and the fuser roller 6 is increased. That is, the fixing strength of the picture image is considerably improved.

As hereinbefore described, the bonding strength of the ink 2 to the printing paper 2 is considerably improved by providing a mechanism for coating the cross-linking material a to cross-link the molecular structure of the ink 2 at a specific position in contact with the photosensitive belt 1 between the transfer roller 5 and the squeezing roller 4. The anti-blocking property is also improved to a large extent.

In the above preferred embodiment, the solvent of the ink 2 is squeezed to some extent by the squeezing roller 4, and the cross-ling material a is then added to the 2 ink and the ink 2 is solidified into the cross-linked solid by heat from the transfer roller 5 and the fuser roller 6, so that the ink is transferred and fixed on the printing paper 7 while being maintained as a solid.

As described above, according to the image forming apparatus and the image forming method of the present invention, since a coating device 8–10 is provided in contact with the photosensitive belt 1 between the transfer roller 5 and the squeezing roller such that the cross-linking material a for cross-linking the molecular structure of the ink 2 can be added to the ink 2 which produces the picture images by developing the images formed on the photosensitive belt 1, the bonding strength of the ink 2 with the printing paper 7 and the anti-blocking property are greatly increased.

What is claimed is:

1. An image forming apparatus comprising:

a photosensitive belt made of a photosensitive body for bearing latent images;

a developing roller for developing the latent images by an ink composed of toner particles dispersed in a solvent to thereby generate developed images;

a transfer roller for transferring the developed images to printing paper, said transfer roller being in contact with said photosensitive belt, the transfer roller having an internal heater;

a fuser roller which is in contact with said transfer roller and which has an internal heater; and a coating device for applying a cross-linking material to the developed images for cross-linking the molecular structure of the ink forming the developed images, the coating device being disposed in contact with said photosensitive belt between said developing roller and said transfer roller.

2. The image forming apparatus according to claim 1 further comprising:

a removing device for removing a designated amount of the solvent of the ink by pressurizing the ink, said removing device being disposed between said coating device and said developing roller.

3. The image forming apparatus according to claim 1, wherein the ink has the characteristics that it is solidified by removing the solvent of the ink by heat or by pressure, and that the ink is transferable to a material which has a high affinity to the ink.

4. The image forming apparatus according to claim 1, wherein the affinity of said photosensitive belt to the ink is less than the affinity of said transfer roller to the ink which is less than the affinity of the printing paper to the ink.

5. A method of forming images by an image forming machine comprising the steps of;

forming latent images on a phototsensitive belt;

generating developed images by developing the latent images using ink composed of toner particles dispersed in a solvent;

applying a cross-linking material to the developed images for cross-linking the molecular structure of the ink; and transferring the developed images to printing paper.

6. A recording medium which stores a program for executing the method of forming images according to claim 5.

* * * * *